US005104160A

United States Patent [19]

Cheng

[11] Patent Number: 5,104,160

[45] Date of Patent: Apr. 14, 1992

[54] BALLOON TYING DEVICE AND METHOD

[76] Inventor: Peter S. C. Cheng, 5 Ross Street, Toronto, Ontario, Canada, M5T 1Z8

[21] Appl. No.: 766,125

[22] Filed: Sep. 27, 1991

[51] Int. Cl.[5] ..... D03J 3/00

[52] U.S. Cl. ..... 289/17; 289/1.5

[58] Field of Search ..... 289/1.5, 2, 17, 121; 446/220, 222

[56] References Cited

U.S. PATENT DOCUMENTS

| | | | |
|---|---|---|---|
| 3,783,551 | 1/1974 | Allison et al. | 446/222 |
| 4,029,346 | 6/1977 | Browning | 289/17 |
| 4,391,063 | 7/1983 | Gill, III | 446/222 |
| 4,510,653 | 4/1985 | Semanko | 289/17 |
| 4,525,002 | 6/1985 | Herubel | 289/2 |
| 4,802,877 | 2/1989 | Davis et al. | 289/1.5 |
| 4,989,906 | 2/1991 | Peverley | 289/18.1 |
| 5,039,142 | 8/1991 | Muma | 289/17 |

*Primary Examiner*—Werner H. Schroeder
*Assistant Examiner*—Michael A. Neas
*Attorney, Agent, or Firm*—Kirschstein, Ottinger, Israel & Schifemiller

[57] ABSTRACT

A sliding noose of a lasso is held open on a support while the neck of a balloon to be tied is inserted into the open noose. Thereafter, relative displacement between the support and the balloon causes the noose to be released from the support. The noose is closed tightly about the balloon neck during such displacement.

10 Claims, 2 Drawing Sheets

BALLOON TYING DEVICE AND METHOD

BACKGROUND OF THE INVENTION

1. Field of the Invention

This invention generally relates to a device for and a method of tying balloons.

2. Description of Related Art

Various methods and devices for tying balloons are known from U.S. Pat. Nos. 3,783,551; 4,391,063; 4,510,653; 4,802,877 and 4,989,906.

Although generally satisfactory for their intended purpose, the known balloon tying methods and devices require a practiced manual dexterity which does not facilitate the quick and easy tying of the necks of such balloons, especially by children who may not possess the required dexterity and, in some cases, by adults who find their fingers are too large to tie the necks of smaller balloons.

SUMMARY OF THE INVENTION

It is a general object of this invention to reliably tie a balloon in a quick and easy manner without requiring a practiced dexterity beyond the skill of children.

In keeping with this object, and others which will become apparent hereinafter, one feature of this invention resides, briefly stated, in a device for and method of tying a balloon having a neck which comprises a lasso having a sliding noose, and a support means displaceable relative to a balloon to be tied. The support means holds the noose open to receive the balloon neck within the open noose. The support means also releases the noose therefrom to slide the noose closed tightly about the balloon neck upon displacement of the support means relative to the balloon.

In accordance with this invention, it is merely necessary to insert the neck of the balloon into the open noose, and thereafter to effect relative displacement between the support means and the balloon to tie the balloon neck closed. This prior open deployment of the noose greatly simplifies the balloon tying technique such that the technique does not require great manual dexterity and is not dependent upon the size of a person's fingers.

In a preferred embodiment, the lasso is an elongated string having one end region secured to the support means, an opposite end region at which the sliding noose is located, and an intermediate coiled region between the end regions. The coiled region is wound a plurality of times about a spool section of the support means.

The support means is a generally planar support member constituted of heavy-duty paper, cardboard, plastic or metal material having a cutout and a plurality of slits arranged around the cutout. The noose is received in and routed through the slits to form an open loop.

In use, the neck of a balloon to be tied is inserted into the open loop. Thereafter, relative displacement is effected between the support member and the balloon. The support member is pulled away from the balloon, thereby releasing the noose from the support. Continued pulling of the support member away from the balloon causes the noose to close tightly about the balloon neck. The sliding noose includes a slipknot which facilitates the closing of the open loop.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
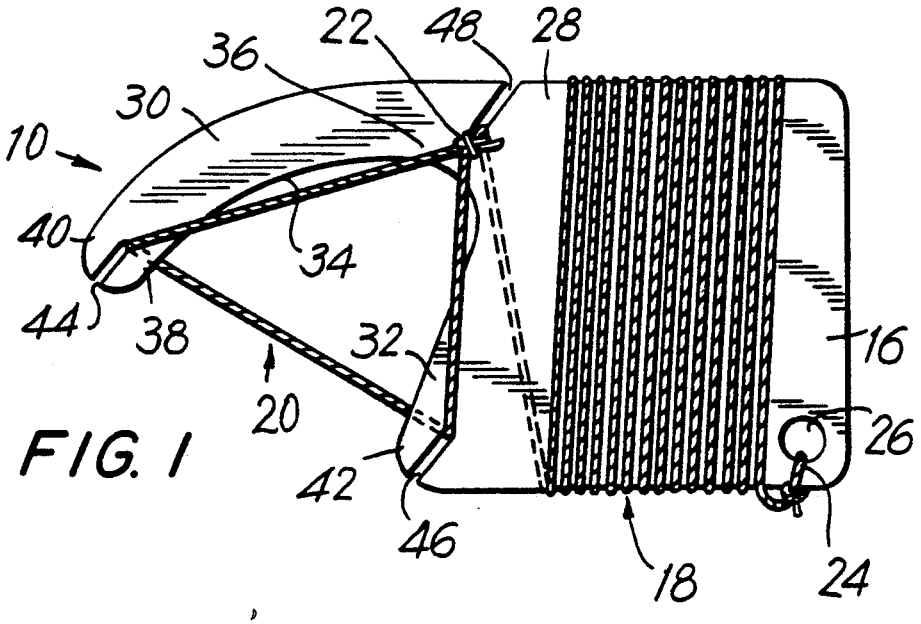
FIG. 1 is a top plan view of a balloon tying device prior to use.

Referring now to the drawings, reference numeral 10 generally identifies a device for tying a balloon 12. The balloon 12 is illustrated as being an elastic, latex balloon, but may equally well be a mylar metal foil-type balloon. Balloon 12 has a neck 14 through which a gas, such as air, helium or the like, is admitted to inflate the balloon.

Figure 5:
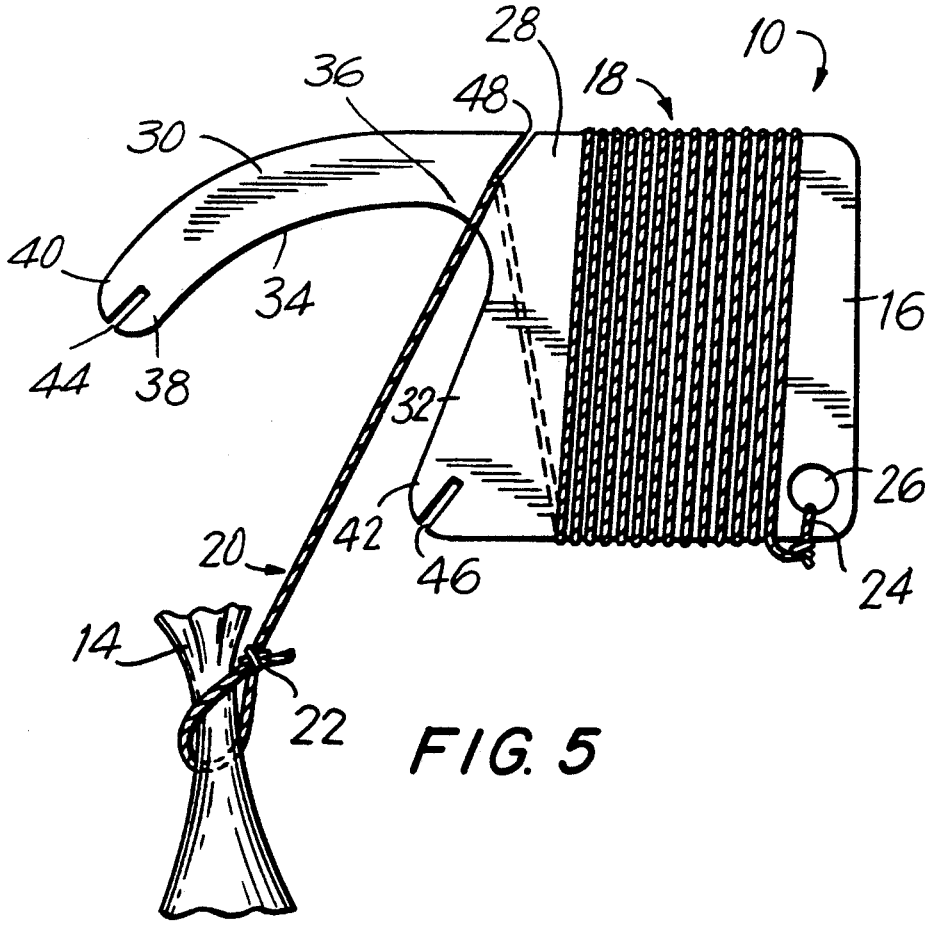
FIG. 5 is a top plan view analagous to FIG. 1 of the device which is prior to completion of tying the balloon.

The device 10 generally includes a support member 16 constituted of a heavy-duty paper, cardboard, plastic or metal material on which a lasso 18 having a sliding noose 20 is supported. The lasso 18 is illustrated as being a string, but may equally well be constituted as a rope, wire, cord, ribbon, cable and, in short, any elongated, flexible tether would serve. The noose 20 is a circumferentially-complete loop which is slidable between an open position (see FIG. 1) and a closed position (see FIG. 5) by a slipknot 22.

The lasso 18 has one end 24 fixedly secured to the support member 16 by being inserted into a hole 26 located at one end region of the support member 16 and being knotted thereat. The opposite end of the lasso is formed as the noose 20. Intermediate these ends of the lasso, the lasso is wound a plurality of times about a spool section 28 of the support member 16.

An arcuate arm portion 30 extends outwardly of the spool section 28 at one side of the support member. Another arm portion 32 extends outwardly of the spool section 28 at an opposite lateral side of the support member. The arm portions 30, 32 together partly bound a generally U-shaped cutout 34 having a closed end 36 and an open end 38. The arm portions 30, 32 are spaced apart of each other, and have outer free ends 40, 42 respectively formed with slits 44, 46. The slits 44, 46 extend in mutual parallelism and open onto the periphery of the support member 16 along a transverse direction generally perpendicular to the plane of the support member 16. Another slit 48 is arranged at the closed end 36. The slits 44, 46, 48 are circumferentially arranged around the cutout. The noose 20 is received in and routed through the slits to form an open loop, as best shown in FIG. 1. The slits may be arranged at the apices of a triangle, in which case, the open loop has a generally triangular configuration. Alternatively, additional slits may be arranged around the cutout to form the open loop with a quadrilateral, generally oval or round configuration.

Figure 2:
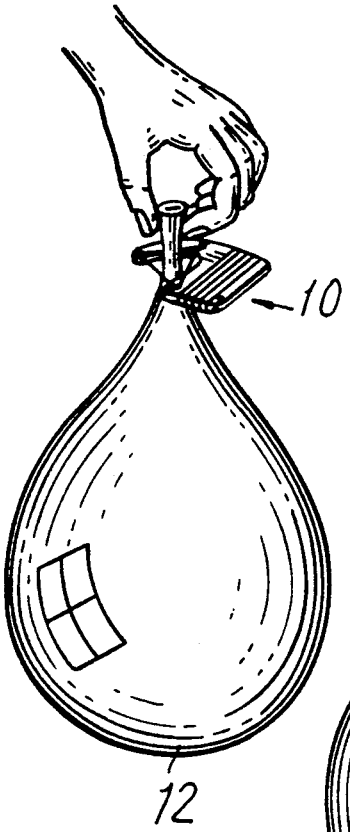
FIG. 2 is a perspective view showing the neck of a balloon to be tied inserted into the open noose of the device of FIG. 1.
Figure 3:
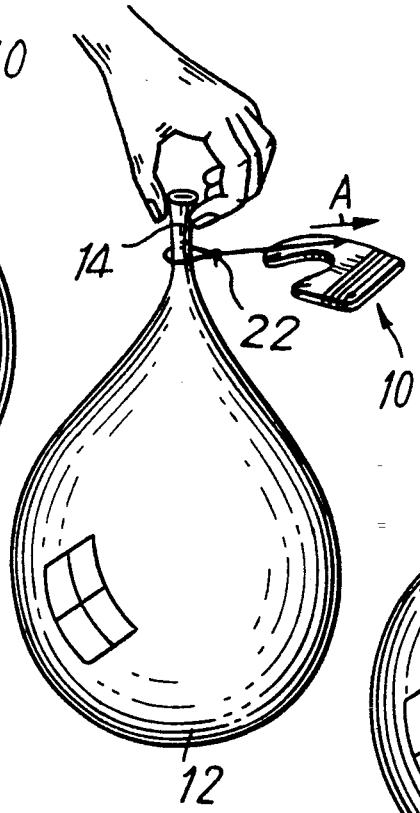
FIG. 3 is a view analogous to FIG. 2 during tying of the balloon.
Figure 4:
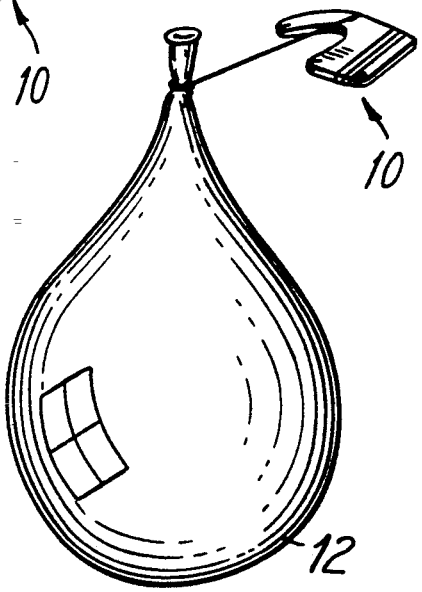
FIG. 4 is a view analogous to FIG. 2 after tying of the balloon has been completed.

In use, the neck 14 of the balloon 12 is inserted into the open loop of the noose 20 (see FIG.2). Thereafter, the support member 16 is manually pulled in the direction of the arrow A depicted in FIG. 3. The noose is detached from the support member 16 by being pulled out of the slits 44, 46. Further pulling of the support member 16 away from the balloon 12 causes the noose to tighten due to sliding of the slipknot 22 (see FIG. 5). Eventually, as shown in FIG. 4, the noose is tightly closed about the balloon neck to seal the gas within the balloon.

No practiced manual dexterity is required. The balloon is quickly and easily tied by merely inserting the neck into the noose and pulling the support member away from the balloon.

After tying has been completed, the coiled portion of the lasso is unwound from the spool section 28 of the support member 16. The support member 16 now serves as a convenient anchor to hold the tethered balloon in place, or as a convenient handle by which one can hold the balloon.

It will be understood that each of the elements described above, or two or more together, also may find a useful application in other types of constructions differing from the types described above.

While the invention has been illustrated and described as embodied in a balloon tying device and method, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A device for tying a balloon having a neck, comprising:

(a) a lasso having a sliding noose; and (b) a support means for supporting the lasso and being displaceable relative to a balloon to be, tied, said support means including means for holding the noose open to receive the balloon neck within the open noose, and means for releasing the noose from the support means to slide the noose closed tightly about the balloon neck upon displacement of the support means relative to the balloon.

2. The device according to claim 1, wherein the lasso is an elongated string having one end region secured to the support means, an opposite end region at which the sliding noose is located, and an intermediate coiled region between the end regions and wound about the support means.

3. The device according to claim 1, wherein the support means is a generally planar support member having a cutout, and a plurality of slits arranged around the cutout, and wherein the noose is received in and routed through the slits to form an open loop.

4. The device according to claim 3, wherein there are three slits arranged at the apices of a triangle, and wherein the open loop has a generally triangular configuration.

5. The device according to claim 3, wherein the support member has elongated arms partly bounding the cutout and having outer ends spaced apart from each other to bound an open end for the cutout, and wherein each of the outer ends has one of the slits formed therein, and wherein the noose has a loop portion spanning the open end of the cutout.

6. The device according to claim 3, wherein the sliding noose includes a slipknot.

7. A method of tying a balloon having a neck, comprising the steps of:

(a) holding open a sliding noose of a lasso on a support;

(b) inserting the neck of a balloon to be tied into the open noose; and (c) effecting relative displacement between the support and the balloon to release the noose from the support and to slide the noose closed tightly about the balloon neck.

8. The method according to claim 7, wherein the holding step is performed by arranging a plurality of slits in the support around the noose, and by routing the noose through the slits prior to performing the inserting step.

9. The method according to claim 8, wherein the arranging step positions the slits at the apices of a triangle to form the open noose with a generally triangular configuration.

10. The method according to claim 7, wherein the displacement step is performed by manually pulling the support away from the balloon.

* * * * *